US005415136A

United States Patent [19]

Doherty et al.

[11] Patent Number: 5,415,136

[45] Date of Patent: May 16, 1995

[54] COMBINED IGNITION AND FUEL SYSTEM FOR COMBUSTION-POWERED TOOL

[75] Inventors: James E. Doherty, Barrington; Ernest J. Wendling, Algonquin; Stanley C. Veoukas, Wheeling, all of Ill.

[73] Assignee: Illinois Tool Works Inc., Glenview, Ill.

[21] Appl. No.: 114,493

[22] Filed: Aug. 30, 1993

[51] Int. Cl.[6] ..... F02B 71/00

[52] U.S. Cl. ..... 123/46 SC; 123/415; 123/630

[58] Field of Search ..... 123/46 SC, 415, 416, 123/417, 418, 478, 630

[56] References Cited

U.S. PATENT DOCUMENTS

| | | | |
|---|---|---|---|
| 4,483,473 | 11/1984 | Wagdy | 123/46 SC |
| 4,483,474 | 11/1984 | Nikolich | 123/46 SC |
| 4,703,732 | 11/1987 | Wineland et al. | 123/416 |
| 4,785,783 | 11/1988 | Oshiage et al. | 123/480 |
| 5,069,182 | 12/1991 | Kako | 123/418 |
| 5,133,329 | 7/1992 | Rodseth et al. | 123/630 |
| 5,191,209 | 3/1993 | Rodseth et al. | 250/229 |
| 5,218,945 | 6/1993 | Kapellen et al. | 123/418 |
| 5,278,762 | 1/1994 | Kawamura | 123/417 |

*Primary Examiner*—Andrew M. Dolinar

*Assistant Examiner*—Thomas N. Moulis

*Attorney, Agent, or Firm*—Schwartz & Weinrieb

[57] ABSTRACT

For a combustion-powered, fastener-driving tool, a combined ignition and fuel system comprises a battery, two normally opened switches connected to the battery, namely a head switch and a trigger switch, a fuel injector including a solenoid and an associated circuit controlling the fuel injector to enable the fuel injector to inject a combustible fuel for a first time interval, a circuit for producing ignition, and a circuit for monitoring the head and trigger switches, for disabling the injector-controlling circuit if the trigger switch is closed while the head switch is opened or if both switches are opened, for enabling the solenoid if the trigger switch is closed while the head switch is closed, for enabling the ignition-producing circuit after a second time interval succeeding the first time interval, and for disabling the ignition-producing circuit when the injector-controlling circuit is disabled as mentioned. The system further comprises a circuit for monitoring the battery voltage, for comparing the monitored voltage to a reference voltage, and for enabling the injector controlling circuit and the ignition-producing circuit if the monitored voltage is not less than the reference voltage, and for disabling the injector-controlling circuit and the ignition-producing circuit if the monitored voltage is less than the reference voltage.

14 Claims, 2 Drawing Sheets

COMBINED IGNITION AND FUEL SYSTEM FOR COMBUSTION-POWERED TOOL

TECHNICAL FIELD OF THE INVENTION

This invention pertains to a combined ignition and fuel system for a combustion-powered tool, such as a combustion-powered, fastener-driving tool. Broadly, the combined system comprises a fuel injector, means for controlling the fuel injector to enable the fuel injector to inject a combustible fuel for a first time interval, and means for producing ignition of the fuel after a second time interval succeeding the first time interval.

BACKGROUND OF THE INVENTION

Combustion-powered, fastener-driving tools, such as combustion-powered, nail-driving tools and combustion-powered, staple-driving tools, are exemplified in Nikolich U.S. Pat. No. Re. 32,452, Nikolich U.S. Pat. No. 4,522,162, and No. 4,483,474, Wagdy U.S. Pat. No. 4,483,473, and Nikolich U.S. Pat. No. 4,403,722.

Typically, such a tool includes switches that must be closed to enable ignition of a combustible fuel in a combustion chamber by means of a spark plug. These switches include a head switch and a trigger switch. The head switch is closed by pressing a workpiece-contacting element, which is operatively mounted to a nosepiece of the tool, firmly against a workpiece. The trigger switch is closed by pulling a trigger, which is operatively mounted to a handle of the tool.

An ignition system for such a tool, employing such head and trigger switches, is disclosed in Rodseth et al. U.S. Pat. No. 5,133,329. The ignition system disclosed therein employs photoelectric head and trigger switches, as disclosed in Rodseth U.S. Pat. No. 5,191,209.

A fuel system for such a tool, employing a fuel injector including a solenoid and an electronic circuit for controlling the solenoid to enable a combustible fuel to flow from a source into the combustion chamber for a time interval after the head switch or the trigger switch is closed, is disclosed in a copending patent application filed Nov. 13, 1992, for FUEL SYSTEM FOR COMBUSTION-POWERED, FASTENER-DRIVING TOOL, and assigned commonly herewith.

As disclosed in the copending application noted above, the time interval is defined by a resistive-capacitive network including a thermistor responsive to ambient temperature, along with a resistor arranged to be selectively connected to condition the system for use at higher altitudes and disconnected to condition the system for use at lower altitudes. As disclosed therein, the fuel system can be well integrated with an ignition system according to Rodseth et al. U.S. Pat. No. 5,133,329 noted above.

In such a tool, as known heretofore, a fan has been employed to produce turbulence in the fuel mixing with air in the combustion chamber. Also, a battery-powered, electric motor has been employed to drive the fan. Since the fan and the electric motor are large contributors to the weight of such a tool and to its manufacturing cost, it would be highly desirable to provide such a tool that could be effectively operated without a fan driven by an electric motor.

SUMMARY OF THE INVENTION

This invention provides for a combustion-powered tool, such as a combustion-powered, nail-driving tool or a combustion-powered, staple-driving tool, comprising a combined ignition and fuel system enabling the tool to be effectively operated without a fan driven by an electric motor. The combined system combines elements of the ignition system disclosed in Rodseth et al. U.S. Pat. No. 5,133,329 noted above, elements of the fuel system disclosed in the copending application noted above, and other elements described below.

Broadly, the combined system comprises a fuel injector, means for controlling the fuel injector to enable the fuel injector to inject a combustible fuel for a first time interval, and means for producing ignition of the combustible fuel after a second time interval succeeding the first time interval. Preferably, the injector-controlling means is arranged to enable the ignition-controlling means when the first time interval has concluded.

More specifically, the combined system comprises a battery, two normally opened switches connected to the battery, namely a head switch and a trigger switch, a fuel injector, means for controlling the fuel injector to enable the fuel injector-to inject a combustible fuel for a first time interval whereupon injection of the combustible fuel terminates, means for producing ignition of the injected fuel, and means for monitoring the head and trigger switches. The switch-monitoring means is arranged for disabling the injector controlling means if the trigger switch is closed while the head switch is opened or if both switches are opened, for enabling the injector-controlling means if the trigger switch is closed while the head switch is closed, and for enabling the ignition-producing means after a second time interval (for example, five to eight milliseconds) succeeding the first time interval. Preferably, the switch-monitoring means is arranged for disabling the ignition-producing means when the injector-controlling means is disabled by the switch-monitoring means.

Preferably, the combined system further comprises battery-monitoring means for monitoring the battery voltage, for comparing the battery voltage monitored thereby to a reference voltage, for disabling the injector-controlling means if the battery voltage monitored thereby is less than the reference voltage, and for enabling the injector-controlling means if the battery voltage monitored thereby is not less than the reference voltage.

Preferably, moreover, the battery-monitoring means is arranged for disabling both the injector-controlling means and the ignition-producing means if the battery voltage monitored thereby is less than the reference voltage, and for enabling both the injector-controlling means and the ignition-producing means if the battery voltage monitored thereby is not less than the reference voltage.

BRIEF DESCRIPTION OF THE DRAWINGS

These and other objects, features, and advantages of this invention will be evident from the following description of a preferred embodiment of this invention with reference to the accompanying drawings, in which like reference characters designate like or corresponding parts throughout the several views, and wherein.

DETAILED DESCRIPTION OF PREFERRED EMBODIMENT

Figure 1A:
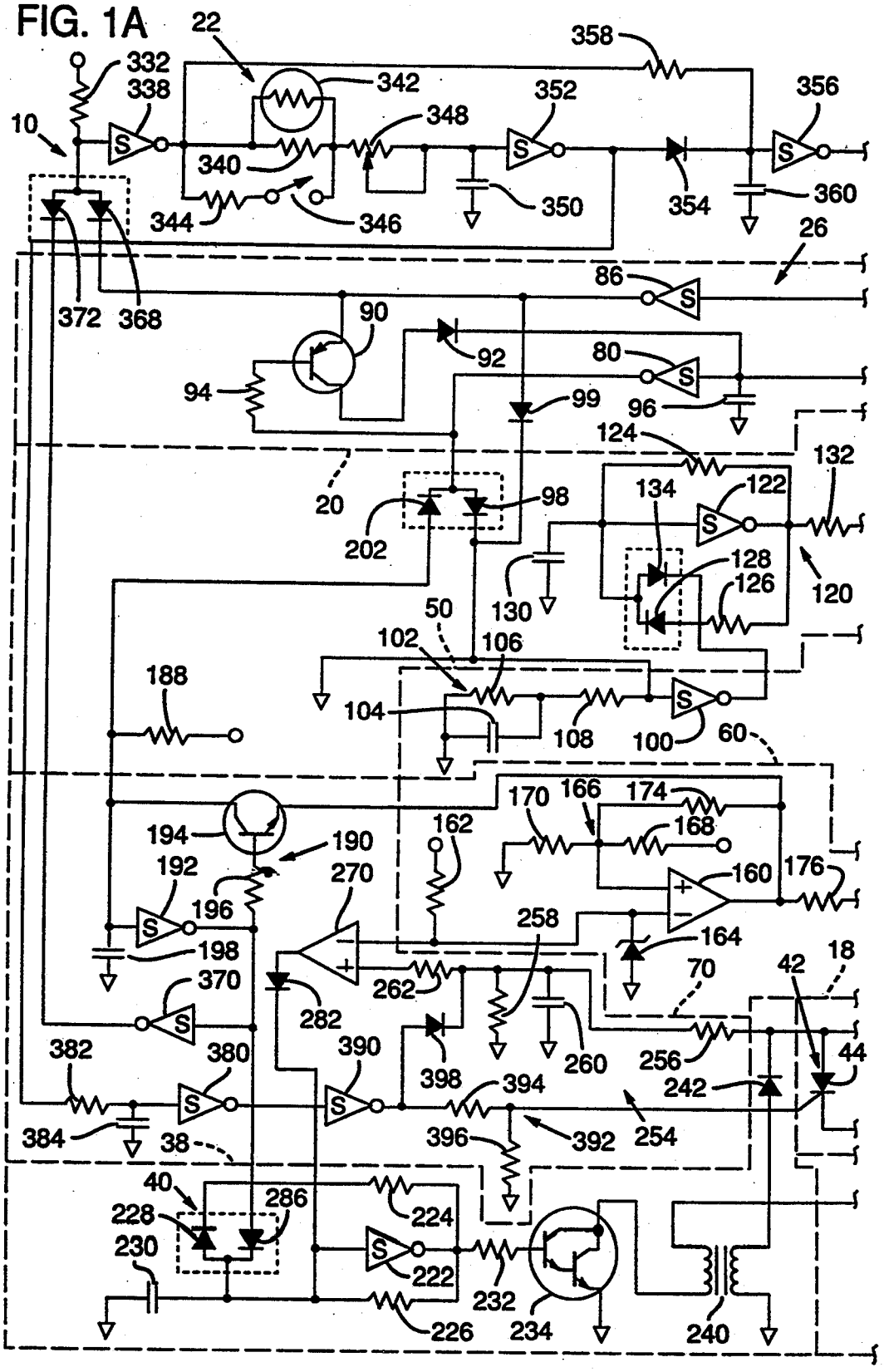
FIGS. 1A and 1B are respective halves of a schematic diagram of a combined ignition and fuel system according to a preferred embodiment of this invention.

As shown diagrammatically, a predominantly solid-state, combined ignition and fuel system 10 for a combustion-powered tool, such as a combustion-powered, nail-driving tool or a combustion-powered, staple-driving tool, constitutes a preferred embodiment of this invention.

The system 10 comprises a battery 12, a normally opened, photoelectric, head switch 14, a normally opened, photoelectric, trigger switch 16, a fuel injector 18 including a solenoid 20 and arranged to inject a combustible fuel into a combustion chamber (not shown) of the tool, a circuit 22 for controlling the solenoid 20 of the fuel injector 18 so as to control injection of the combustible fuel, a circuit 24 for producing ignition, and a circuit 26 for monitoring the switches 14, 16, in a unique arrangement described below. It is convenient to refer to the circuit 22 as the injector-controlling circuit 22, to refer to the circuit 24 as the ignition-producing circuit 22, and to refer to the circuit 26 as the switch-monitoring circuit 26.

Except as illustrated in the drawings and described herein, the fuel injector 18 including the solenoid 20 and the injector-controlling circuit 22 are similar to the fuel system disclosed in Rodseth et al. U.S. Pat. No. 5,133,329 noted above, the disclosure of which is incorporated herein by reference. Each of the switches 14, 16, is a photoelectric switch, as disclosed in Rodseth et al. U.S. Pat. No. 5,191,209 noted above, the disclosure of which is incorporated herein by reference.

Notably, the tool does not employ a fan or an electric, fan-driving motor. Otherwise, except as illustrated and described herein, the combustion-powered tool embodying the system 10 is similar to the combustion-powered, fastener-driving tool illustrated and described in the copending application noted above, the disclosure of which is incorporated herein by reference.

Thus, as illustrated and described therein, the tool comprises a combustion chamber (not shown) into which a combustible, hydrocarbon fuel is injected by the fuel injector 18 for a time interval (for example, eight to twelve milliseconds) determined by the injector-controlling circuit 22 whereupon injection of the combustible fuel terminates. It is convenient to refer to the time interval discussed in the preceding sentence as a first time interval to distinguish it from a succeeding time interval discussed below.

The switch-monitoring circuit 26 is used for monitoring the head switch 14 and the trigger switch 16, for disabling the injector-controlling circuit 22 and the ignition-producing circuit 24 if the trigger switch 16 is closed while the head switch 14 is opened or if both switches are opened, for enabling the injector-controlling circuit 22 if the trigger switch 16 is closed while the head switch 14 is closed, and for enabling the injector-controlling circuit 22 after a second time interval succeeding the first time interval.

The battery 12 is a rechargeable battery comprising a series of nickel-cadmium cells, having a rated voltage of 6.25 volts, and having a rated current of 1.5 amp-hours. The head switch 14 comprises a phototransmissive diode **14*a*, a photoreceptive transistor 14*b*, and a shutter 14*c*, and is regarded as opened when the photoreceptive transistor 14*b* is nonconductive and as closed when the photoreceptive transistor 14*b* is conductive. The trigger switch 16 comprises a phototransmissive diode 16*a*, a photoreceptive transistor 16*b*, and a shutter 16*c*, and is regarded as opened when the photoreceptive transistor 16*b* is nonconductive and as closed when the photoreceptive transistor 16*b* is conductive. Essentially, each of these switches 14, 16**, is similar to the photoelectric switch disclosed in the copending application noted above.

The head switch 14 is closed by pressing a workpiece-contacting element, which is operatively mounted upon a nosepiece of the tool, firmly against a workpiece. The trigger switch 16 is closed by pulling a trigger, which is operatively mounted upon the handle, with the index finger of the same hand. The workpiece-contacting element, the nosepiece, and the handle are not shown.

When each of these switches 14, 16, is closed, the shutter of the switch is moved from a normal position, in which the shutter prevents light generated by the phototransmissive diode thereof from reaching the photoreceptive transistor thereof, into a displaced position, in which the shutter permits light from the phototransmissive diode to reach the photoreceptive transistor. The shutter is biased toward the normal position. Thus, if there is a failure, such as a severed wire, a failed diode, or a failed transistor, such switch does not become falsely closed.

Generally, the ignition-producing circuit 24 comprises a spark plug 30 having a spark gap 32, a capacitor 36 (1.0 $\mu$f) for producing a spark across the spark gap 32 upon a sudden discharge of the capacitor 36, a circuit 38 comprising a charge-pump oscillator 40 for charging the capacitor 36, and a circuit 42 including a silicon-controlled rectifier 44 for producing a sudden discharge of the capacitor 36. The switch-monitoring circuit 26 is arranged to enable the capacitor-charging circuit 38 if the trigger switch 16 is closed while the head switch 14 is closed and to disable the capacitor-charging circuit 38 if the trigger switch 16 is closed while the head switch 14 is opened or if the head switch 14 and the trigger switch 16 are both opened. Normally, therefore, the switch-monitoring circuit 26 disables the capacitor-charging circuit 38.

Moreover, the ignition and fuel system 10 comprises a battery-monitoring circuit 60 for monitoring the battery 12 and for comparing the battery voltage monitored to a reference voltage for the battery 12. The battery-monitoring circuit 60 is arranged to enable the capacitor-charging circuit 38 if the battery voltage monitored by such circuit 60 is not less than the reference voltage for the battery 12. Also, the battery-monitoring circuit 60 is arranged to disable the capacitor-charging circuit 38 if the battery voltage monitored by such circuit 60 is less than the reference voltage for the battery 12, whereby ignition cannot occur.

Furthermore, the ignition and fuel system 10 comprises a capacitor-monitoring circuit 70 for monitoring the capacitor voltage, namely the voltage to which the capacitor 36 is charged by the capacitor-charging circuit 38, and for comparing the capacitor voltage monitored by such circuit 70 to a reference voltage for the capacitor 36. The capacitor-monitoring circuit 70 is arranged to enable the circuit 42 including the silicon-controlled rectifier 44 for producing a sudden discharge of the capacitor 36 if the capacitor voltage monitored by the circuit 70 is not less than the reference voltage for the capacitor 36 and for disabling the same circuit if the capacitor voltage monitored by the circuit 70 is less than the reference voltage for the capacitor 36.

The switch-monitoring circuit 26 does not monitor the head switch 14 and the trigger switch 16 continuously. Rather, the switch-monitoring circuit 26 is arranged for polling the head switch 14 intermittently to determine whether the head switch 14 is closed and for polling the trigger switch 16 intermittently to determine whether the trigger switch 16 is closed, whereby battery energy is conserved.

Figure 1B:
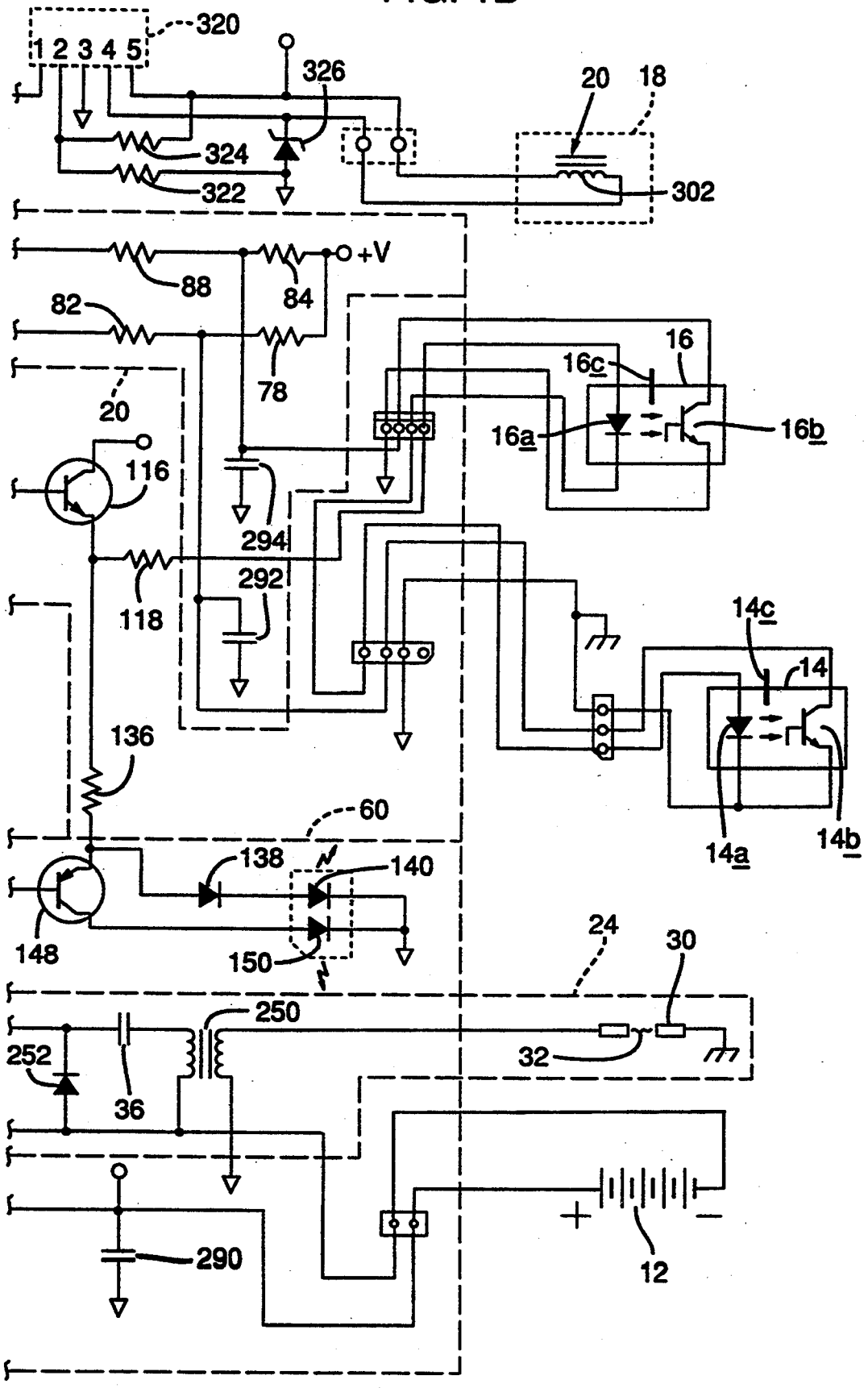

In the switch-monitoring circuit 26, as shown in FIG. 1B, the phototransmissive diodes 14*a*, 16*a*, of the respective switches 14, 16, are connected in series between the positive terminal of the battery 12 and ground, by means of the switch-monitoring circuit 26, so as to be intermittently connected to the positive terminal of the battery 12 as such circuit 26 polls the respective switches 14, 16. The photoreceptive transistor 14*b* of the head switch 14 is connected to the positive terminal of the battery 12, through a resistor 78 (10K Ω), and to the input pin of an inverter (Schmitt trigger) 80, through a resistor 82 (100K Ω). When the head switch 14 is closed, that is, when the photoreceptive transistor 14*b* becomes conductive, the input voltage to the inverter 80 drops to a low value and the output voltage from the inverter 80 rises to a high value. The photoreceptive transistor 16*b* of the trigger switch 16 is connected to the positive terminal of the battery. 12, through a resistor 84 (10K Ω), and to the input pin of an inverter (Schmitt trigger) 86, through a resistor 88 (100K Ω). When the trigger switch 16 is closed, that is, when the photoreceptive transistor 16*b* becomes conductive, the input voltage to the inverter 86 drops to a low voltage whereupon the output voltage from the inverter 86 rises to a high voltage.

If the output voltage from the inverter 80 is high, the capacitor-charging circuit 38 is enabled. If the output voltage from the inverter 80 is low, the capacitor-charging circuit 38 is disabled. So long as the head switch 14 and the trigger switch 16 are both opened, which means that the photoreceptive transistors 14*b*, 16*b*, are nonconductive, the input voltages to the respective inverters 80, 86, are high and the output voltages from the respective inverters 80, 86, are low.

A transistor 90 is connected between the output pin of the inverter 86 and the input pin of the inverter 80, through a diode 92, which is forward biased when the transistor 90 is switched on. The base of the transistor 90 is connected to the output pin of the inverter 80, through a resistor 94 (100K Ω). A capacitor 96 (0.001 μf) is connected between the input pin of the inverter 80 and the negative terminal of the battery 12.

If the trigger switch 16 is closed while the head switch 14 is opened, that is, if the photoreceptive transistor 16*b* becomes conductive while the photoreceptive transistor 14*b* is nonconductive, the transistor 90 is switched on to apply a high voltage to the input pin of the inverter 80. Also, if signals, indicating that the head switch 14 and the trigger switch 16 are closed, are received simultaneously, the delay caused by the capacitor 96 insures that the transistor 90 is switched on and that the transistor 90 applies a high voltage to the input pin of the inverter 80. As a result, the input to the inverter 80 is latched high, and the output from the inverter 80 is low. If the trigger switch 16 is closed while the head switch 14 is closed, that is, if the photoreceptive transistors 14*b*, 16*b*, become conductive, the transistor 90 is switched off so that no high voltage is applied to the input pin of the inverter 80.

A transistor 116 is connected between the positive terminal of the battery 12 and the series-connected, phototransmissive diodes 14*a*, 16*a*, of the respective switches 14, 16, by means of a resistor 118 (1Ω, ⅛ W), so as to connect such diodes 14*a*, 16*a*, to the positive terminal of the battery 12 whenever the transistor 116 is switched on. An oscillator 120, which has a conventional configuration, comprises an inverter (Schmitt trigger) 122 and a resistor 124 (2M Ω) in parallel, a resistor 126 (12K Ω) and a diode 128 in parallel therewith, and a capacitor 130 (0.22 μf) connecting the input pin of the inverter 122 to the negative terminal of the battery 12.

The output pin of the inverter 122 is connected to the base of the transistor 116 by means of a resistor 132 (3.3K Ω), so as to switch the transistor 116 on and off intermittently as the oscillator 120 oscillates, thereby conversing battery energy as the respective switches 14, 16, are polled. The input pin of the inverter 122 is connected to the output pin of the inverter 100 by means of a diode 134. When the output voltage from the inverter 100 is a low voltage, the oscillator 120 is latched by means of the diode 134 so that the output voltage from the inverter 122 remains high.

The transistor 116 is connected by means of a resistor 136 (100Ω) and a diode 138 to a green light-emitting diode 140, which flashes intermittently as the transistor 116 is switched on and off intermittently, and which serves as an indicator that the ignition and fuel system 10 is in a stand-by mode. Also, the green light-emitting diode 140 is steadily illuminated when the oscillator 120 is latched so that the output voltage from the inverter 122 remains high, as an indicator that the ignition and fuel system 10 is in a ready mode or in a delay mode. A transistor 148 and a red light-emitting diode 150 are connected in parallel with the diode 138 and the green light-emitting diode 140.

The battery-monitoring circuit 60 comprises a comparator (operational amplifier) 160 having a reference pin, an input pin, and an output pin. A resistor 162 (100K Ω) is connected between the reference pin of the comparator 160 and the positive terminal of the battery 12. A voltage reference diode 164 is connected between the reference pin of the comparator 160 and the negative terminal of the battery 12. By means of the resistor 162 and the voltage reference diode 164, a reference voltage for the battery 12 is applied to the reference pin of the comparator 160. A voltage divider 166 comprising a resistor 168 (301K Ω, 1%) connected between the positive terminal of the battery 12 and the input pin of the comparator 160, a resistor 170 (100K Ω, 1%) connected between the input pin of the comparator 160 and the negative terminal of the battery 12, and a resistor 174 (10M Ω) connected between the input and output pins of the comparator 160 applies a voltage proportional to the battery voltage to the input pin of the comparator 160.

If the voltage applied to the input pin of the comparator 160 is not less than the reference voltage for the battery 12, the voltage at the output pin of the comparator 160 is high. If the voltage applied thereto is less than the reference voltage for the battery 12, the voltage at the output pin of the comparator 160 is low. The voltage at the output pin of the comparator 160 is applied by means of a resistor 176 (3.3K Ω) to the base of the transistor 148. If the voltage applied to the base of the transistor 148 is low the transistor 148 is switched on, so as to create a short circuit across the diode 138 and the green light-emitting diode 140, and so as to steadily illuminate the red light-emitting diode 150, as an indicator that the battery voltage is inadequate. If the output voltage applied to the transistor 148 is a high voltage, the transistor 148 is not switched on, and the green light-emitting diode 140 is illuminated.

The capacitor-charging circuit 38 is connected to the positive terminal of the battery 12 by means of a resistor 188 (100K Ω) and a latching circuit 190. The latching circuit 190 comprises an inverter (Schmitt trigger) 192 having its input pin connected to the resistor 188, a transistor 194 connected to the input pin of the inverter 192, a resistor 196 (100K Ω) connected between the output pin of the inverter 192 and the base of the transistor 194, and a capacitor 198 (0.01 μf) connecting the input pin of the inverter 192 to the negative terminal of the battery 12. The transistor 194 is connected to the output pin of the comparator 160.

Normally, the output voltage from the inverter 192 is a high voltage, which switches on the transistor 194. When the output voltage from the comparator 160 is a low voltage, which means that the battery voltage is insufficient, the transistor 194 remains switched on so as to disable the capacitor-charging circuit 38. As long as the output voltage from the comparator 160 is a low voltage, the latching circuit 190 is latched on and continues to disable the capacitor-charging circuit 38 until the output of the comparator 160 is a high voltage, which means that the battery voltage is sufficient for proper operation.

The resistor 188, the capacitor 198, and the input pin of the inverter 192 are connected to the output pin of the inverter 80, by means of a diode 202. When the output voltage from the inverter 80 is low, the voltage applied to the input pin of the inverter 192 is insufficient to cause the inverter 192 to invert. Also, when the transistor 194 is conducting, the voltage applied to the input pin of the inverter 192 is insufficient to cause the inverter 192 to invert. Otherwise, when the output voltage from the inverter 80 is high, a high voltage is applied to the input pin of the inverter 192. Thus, the inverter 192 exhibits a low voltage from its output pin. By means of the resistor 196, the low voltage from the output pin of the inverter 192 is applied to the base of the transistor 194, which is switched off, which means that the latching circuit 190 is off. At this time, even if the battery voltage drops transiently below the reference voltage for the battery 12 when the capacitor-charging circuit 38 is operating, the latching circuit 190 does not disable the capacitor-charging circuit 38.

By means of a diode 286, the output pin of the inverter 192 is connected to the charge-pump oscillator 40 of the capacitor-charging circuit 38. The charge-pump oscillator 40, which has a conventional configuration, comprises an inverter (Schmitt trigger) 222 and a resistor 226 (820K Ω) in parallel, a resistor 224 (130K Ω) and a diode 228 in parallel therewith, and a capacitor 230 (0.001 μf) connecting the input pin of the inverter 222 to the negative terminal of the battery 12. The output voltage from the output pin of the inverter 222 is connected by means of a resistor 232 (3.3K Ω) to the base of a Darlington transistor 234, which is connected in series with the primary winding of a step-up transformer 240. The primary winding of the transformer 240 is connected to the positive terminal of the battery 12. The secondary winding of the transformer 240 is connected by means of a diode 242 to the capacitor 36. Thus, as the charge-pump oscillator 40 oscillates, the capacitor 36 is charged in a stepwise manner.

The capacitor 36 is connected in series with the primary winding of an output transformer 250. A diode 252 connected in parallel with the capacitor 36 and the primary winding of the transformer 250 is intended to be normally nonconductive but to break down so as to increase the spark duration in a manner explained below. The secondary winding of the transformer 250 is connected to one electrode of the spark plug 30. The other electrode of the spark plug 30 is grounded. Thus, upon a sudden discharge of the capacitor 36, a spark is produced at the spark gap 32 of the spark plug 30. The silicon-controlled rectifier 44 is connected in parallel with the capacitor 36 and the primary winding of the transformer 250, and in parallel with the diode 252, so as to produce a sudden discharge of the capacitor 36 through the primary winding of the transformer 250 when the silicon-controlled rectifier 44 is switched on. After the initial, sudden discharge, reverse induced current is allowed to flow through the primary winding of the transformer 250 by means of the diode 252, which recharges the capacitor 36. This charge/discharge/recharge oscillation between the primary winding of the transformer 250 and the capacitor 36 greatly increases the spark duration time.

In the capacitor-monitoring circuit 70, a voltage divider 254 comprising a resistor 256 (10M Ω) connected to the capacitor 36, a resistor 258 (46.4K Ω, 1%)) and a capacitor 260 (0.022 μf) connected in parallel between the resistor 256 and the negative terminal of the battery 12, and a resistor 262 (10K Ω) applies a voltage proportional to the voltage to which the capacitor 36 has been charged to the input pin of a comparator (operational amplifier) 270. The resistor 162 noted above in the context of the comparator 160 is connected between the reference pin of the comparator 270 and the positive terminal of the battery 12. The voltage reference diode 164 noted above in the same context is connected between the reference pin of the comparator 270 and the negative terminal of the battery 12. By means of the resistor 162 and the voltage reference diode 164, a reference voltage for the capacitor 36 is applied to the reference pin of the comparator 270. Because the resistor 162 and the voltage reference diode 164 define the reference voltage for the capacitor 36 as well as the reference voltage for the battery 12, the reference voltages therefor are equal. If the voltage applied to the input pin of the comparator 270 is not less than the reference voltage for the capacitor 36, the output voltage from the output pin of the comparator 270 is high. If the voltage applied to the input pin of the comparator 270 is less than the reference voltage for the capacitor 36, the output voltage from the output pin of the comparator 270 is low.

A high voltage from the output pin of the comparator 270 is applied, by means of a diode 282, to the input pin of the inverter 222 so as to latch the output of the inverter 222 low. A new ignition therefore cannot be initiated until the trigger switch 16 has been opened.

So as to stabilize the circuits and to minimize susceptibility to false triggering stimuli from outside sources, such as radio frequency interference and electrical noise, a capacitor 290 (10 μf) is connected across the battery 12. Moreover, a capacitor 292 (0.047 μf) is associated with the resistor 82, so as to protect the inverter 80, and a capacitor 294 (0.047 μf) is associated with the resistor 88, so as to protect the inverter 86.

The green light-emitting diode 140 and the red light-emitting diode 150 function as mode indicators. When the green light-emitting diode 140 is flashing, the ignition system 10 is in a low current consumption, standby mode, in which the battery voltage monitored by the battery-monitoring circuit 60 is not less than the reference voltage for the battery 12 and in which the head switch 14 and the trigger switch 16 are both opened. When the green light-emitting diode 140 is steadily illuminated, the ignition system 10 is in a ready mode, in which the head switch 14 has been closed or the trigger switch 16 has been closed, or in a delay mode, in which the head switch 14 and the trigger switch 16 have been opened. After a time delay, the ignition system 10 leaves the delay mode and reenters the standby mode. Also, the ignition system 10 has an ignition mode, which it enters from the ready mode when the trigger switch 16 is closed and which it leaves when the trigger switch 16 is opened.

Except as illustrated and described herein, the fuel injector 18 is similar to the fuel injector disclosed in the copending application noted above. Thus, the fuel injector 18 includes the solenoid 20, which has a solenoid coil 302, and the injector-controlling circuit 22, which is similar in many respects to the injector-controlling circuit disclosed in such copending application.

The injector-controlling circuit 22 includes a solenoid driver 320 of a known type, namely a Model MC3484S2-1 integrated, monolithic solenoid driver available commercially from Motorola, Inc. of Schaumburg, Ill. Details of the solenoid driver 320 and its operation are well known to persons having ordinary skill in the art and are outside the scope of this invention.

Pin 1 of the solenoid driver 320 is connected in a manner to be later described. Pin 2 thereof is connected to the negative terminal of the battery 12, by means of a resistor 322 (1K Ω) and to pin 5 thereof, by means of a resistor 324 (18K Ω). Pin 3 thereof is connected to the negative terminal of the battery 12. Pin 4 thereof is connected to a selected end of the solenoid coil 302. Pin 5 thereof is connected to pin 2 thereof, via the resistor 324, to the positive terminal of the battery 12, and to the opposite end of the solenoid coil 302. A zener diode 326 is connected between the selected end of the solenoid coil 302 and the negative terminal of the battery 12 so as to protect the solenoid driver 320 against high countervoltages when electromagnetic fields in the solenoid coil 302 collapse.

The respective ends of the solenoid coil 302 to be thus connected to pins 4 and 5 of the solenoid driver 320 are selected so that a valve (not shown) of the fuel injector 18 is opened by the solenoid coil 302 when the solenoid coil 302 is energized and closed by a spring (not shown) of the solenoid 20 when the solenoid coil 302 is deenergized. The solenoid driver 320 is arranged so that, when a high voltage is applied to pin 1 thereof, the solenoid coil 302 is energized, and so that, when the high voltage applied thereto is removed, the solenoid coil 302 is deenergized.

Also, the circuit 22 comprises a resistor 332 (100K Ω) and an inverter (Schmitt trigger) 338 having its input pin connected to the positive terminal of the battery 12, by means of the resistor 332.

A resistor 340 (510K Ω) is connected to the output pin of the inverter 338. A thermistor 342 (500K Ω) is connected in parallel with the resistor 340. A resistor 344 (1M Ω) and a switch 346 are arranged so that the resistor 344 can be selectively connected in parallel with the resistor 340 and with the thermistor 342 by closing the switch 346, and disconnected by opening the switch 346. A variable resistor 348 (1M Ω) is connected to the resistor 340, to the thermistor 342, and to the resistor 344 if the switch 346 is closed. A capacitor 350 (0.01 μf) is connected between the variable resistor 348 and the negative terminal of the battery 12.

The variable resistor 348 and the capacitor 350 are connected to the input pin of an inverter (Schmitt trigger) 352. The output pin of the inverter 352 is connected, by means of a diode 354, to the input pin of an inverter (Schmitt trigger) 356. The diode 354 is arranged to block reverse current through the inverter 352. The output pin of the inverter 338 is connected, by means of a resistor 358 (22K Ω), to the input pin of the inverter 356. A capacitor 360 (0.001 μf) is connected between the input pin of the inverter 356 and the negative terminal of the battery 12. The output pin of the inverter 356 is connected to pin 1 of the solenoid driver 320.

The several inverters (Schmitt triggers) noted above are provided by a Model 74HC14M (CMOS) device available commercially from National Semiconductor Corporation of Santa Clara, Calif.

The resistor 340, the thermistor 342, the resistor 344 if connected, and the capacitor 350 define a resistive-capacitive network for defining a first time interval, during which the solenoid coil 302 is energized so as to open the valve of the fuel injector 18. The thermistor 342 is a resistor having a negative temperature coefficient of resistance. Thus, the first time interval is shorter at higher temperatures, at which less fuel is required. Also, the first time interval is longer at lower temperatures, at which more fuel is required. The first time interval is shorter when the resistor 344 is connected in parallel with the resistor 340 and with the thermistor 342, and longer when the resistor 344 is disconnected. When the resistor 344 is connected in parallel with resistor 340 and thermistor 342, the tool is conditioned for use at higher altitudes, at which less fuel is required. When the resistor 344 is disconnected, the tool is conditioned for use at lower altitudes, at which more fuel is required. A variable resistor (not shown) for conditioning the tool for use over a range of altitudes can be advantageously substituted for the resistor 344. The variable resistor 348 can be suitably varied to condition the tool for use with different fuels.

The resistor 358 and the capacitor 360 define a resistive-capacitive network for effecting a time delay between switching of the output of the inverter 338 from high to low and energization of the solenoid coil 302.

When the voltage at the input pin of the inverter 338 is low, high voltage is applied by the output pin of the inverter 338 to the input pin of the inverter 352, by means of the parallel resistors including the resistor 340 and the thermistor 342 and by means of the variable resistor 348, whereby the capacitor 350 is charged. High voltage is applied by the output pin of the inverter 338 to the input pin of the inverter 356, by means of the resistor 358, whereby the capacitor 360 is charged. Although low voltage is present at the output pin of the inverter 352, the diode 354 does not permit the capacitor 360 to discharge to the output pin of the inverter 352.

When the voltage at the input pin of the inverter 338 is switched from low to high, the voltage at the output pin of the inverter 338 drops sufficiently for the inverter 338 to switch its state, whereupon the capacitor 350 begins to discharge, by means of the resistor 348 and the resistor 340, the thermistor 342, and the resistor 344 if connected, to the output pin of the inverter 338, and the capacitor 360 begins to discharge, by means of the resistor 358, to the output pin of the inverter 338. The capacitor 360 discharges more rapidly.

As the capacitor 360 discharges, the voltage at the input pin of the inverter 356 drops. When the capacitor 360 has discharged sufficiently for the inverter 356 to switch its state, high voltage is applied by the output pin of the inverter 356 to pin 1 of the solenoid controller 320, whereupon the solenoid coil 302 is energized. Thus, there is a time delay between switching of the output voltage of the inverter 338 from low to high and energization of the solenoid coil 302. The voltage at the output pin of the inverter 352 remains low until the capacitor 350 has discharged sufficiently for the inverter 352 to switch its state. The resistor 358 and the capacitor 360 also provide some protection against transient voltages.

When the capacitor 350 has discharged sufficiently for the inverter 352 to switch its state, high voltage is applied to the input pin of the inverter 356. Because the diode 354 provides minimal impedance compared to the resistor 358, the inverter 356 switches its state, even if the voltage at the output pin of the inverter 338 remains low. Thus, the voltage applied by the output pin of the inverter 356 to pin 1 of the solenoid controller 320 drops, whereupon the solenoid coil 302 is deenergized.

The input pin of the inverter 338 is connected to the output pin of the inverter 86 and to the transistor 90, by means of a diode 368. Thus, whenever the output voltage from the inverter 86 is low or the transistor 90 is conducting, the diode 368 is conducting so that the input voltage to the inverter 338 remains low.

The input pin of the inverter 338 is also connected to the output pin of an inverter (Schmitt trigger) 370, by means of a diode 372. The input pin of the inverter 370 is connected to the output pin of the inverter 192. Thus, whenever the output voltage from the inverter 192 is high so that the output voltage from the inverter 370 is low, the diode 372 is conducting so that the input voltage to the inverter 338 remains low.

Therefore, the output voltage from the inverter 338 does not switch from high to low unless the trigger switch 16 is closed while the head switch 14 is closed, whereby the output voltage from the inverter 86 is switched from low to high and the transistor 90 is switched off, and unless the battery voltage is sufficient, whereby the output voltage from the inverter 192 is switched from high to low so that the output voltage from the inverter 370 is switched from low to high.

As explained below, the injector-controlling circuit 22 is interconnected with the switch-monitoring circuit 26 and with the ignition-producing circuit 24, so as to produce ignition after a second time interval (for example, five to eight milliseconds) succeeding the first time interval.

The output pin of the inverter 352 is connected to the input pin of an inverter (Schmitt trigger) 380, by means of a resistor 382 (820K Ω), and a capacitor 384 (0.01 μf) is connected to the input pin of the inverter 380. The resistor 382 and the capacitor 384 define a resistive-capacitive network for determining the second time interval. When the voltage output from the inverter 352 switches from low to high, the capacitor 384 begins to charge. After the second time interval, when the capacitor 384 has become sufficiently charged,.the output voltage from the inverter 380 is switched from high to low.

The output pin of the inverter 380 is connected to the input pin of an inverter 390. The output pin of the inverter 390 is connected by means of a voltage divider 392, which comprises a resistor 394 (3.3K Ω) and a resistor 396 (1K Ω) connected between the resistor 394 and the negative terminal of the battery 12, to the gate of the silicon-controlled rectifier 44. When the output voltage from the inverter 380 is switched from high to low, the output voltage from the inverter 390 is switched from low to high.

When the output voltage from the inverter 390 is switched from low to high, a high voltage is applied to the gate of the silicon-controlled rectifier 44, which is switched on so as to produce a sudden discharge of the capacitor 36 through the primary winding of the output transformer 250. The sudden discharge of the capacitor 36 produces ignition at the spark plug 30.

The output pin of the inverter 390 is connected to the resistor 262, where the resistor 262 is connected to the resistor 258 and the capacitor 260, by means of a diode 398. When a high voltage is applied to the gate of the silicon-controlled rectifier 44, a high voltage is applied to the input pin of the comparator 270, and the capacitor 260 is charged. Thus, when the silicon-controlled rectifier 44 is switched on, the output of the comparator 270 is latched high so as to disable the capacitor-charging circuit 38 while ignition is being produced.

Because the second time interval is short (for example, five to eight milliseconds) ignition is produced while the injected fuel continues to swirl turbulently in the combustion chamber. It is not necessary, therefore, to employ a fan to produce turbulence in the combustion chamber.

The several inverters (Schmitt triggers) noted above are provided by Model 74HC14M (CMOS) devices available commercially from National Semiconductor Corporation of Santa Clara, Calif.

Herein, all values stated parenthetically for elements of the system 10 are exemplary values, which are useful in a preferred example of the preferred embodiment illustrated in the drawings and described above. Such values are not intended to limit this invention.

Various modifications may be made in the preferred embodiment described above without departing from the scope and spirit of this invention. It is therefore to be understood that within the scope of the appended claims, the present invention may be practiced otherwise than as specifically described herein.

We claim:

1. For a combustion-powered tool, a combined ignition and fuel system, comprising:

a fuel injector;

a normally open head switch adapted to be closed as a result of said tool being pressed against a workpiece;

a normally open trigger switch adapted to be closed by manual operation when said tool is to be used;

means for controlling said fuel injector so as to enable said fuel injector to inject a combustible fuel for a first time interval; and means for producing ignition of said fuel at a second time interval commencing after said first time interval has commenced and only when said head switch and said trigger switch are both closed.

2. The system of claim 1 wherein the injector-controlling means is arranged to enable the ignition-controlling means when the first time interval has concluded.

3. The system as set forth in claim 1, further comprising:

means for monitoring said head and trigger switches such that if one of said head and trigger switches is open, said fuel injector-controlling means and said ignition-producing means are disabled.

4. The system as set forth in claim 3, further comprising:

a battery for supplying electrical power to said tool;

means for monitoring battery voltage;

means for comparing said monitored battery voltage to a reference voltage; and means for disabling said injector-controlling means if said monitored battery voltage is less than said reference voltage, and for enabling said injector-controlling means if said monitored battery voltage is not less than said reference voltage.

5. The system as set forth in claim 1, further comprising:

a battery for supplying electrical power to said tool;

means for monitoring battery voltage;

means for comparing said monitored battery voltage to a reference voltage; and means for disabling said injector-controlling means if said monitored battery voltage is less than said reference voltage, and for enabling said injector-controlling means if said monitored battery voltage is not less than said reference voltage.

6. The system as set forth in claim 1, further comprising:

a battery for supplying electrical power to said tool;

means for monitoring battery voltage;

means for comparing said monitored battery voltage to a reference voltage; and means for disabling said injector-controlling means and said ignition-producing means if said monitored battery voltage is less than said reference voltage, and for enabling said injector-controlling means and said ignition-producing means if said monitored battery voltage is not less than said reference voltage.

7. The system as set forth in claim 3, further comprising:

a battery for supplying electrical power to said tool;

means for monitoring battery voltage;

means for comparing said monitored battery voltage to a reference voltage; and means for disabling said injector-controlling means and said ignition-producing means if said monitored battery voltage is less than said reference voltage, and for enabling said injector-controlling means and said ignition-producing means if said monitored battery voltage is not less than said reference voltage.

8. The system as set forth in claim 1, wherein:

said first time interval is approximately 8–12 milliseconds; and said second time interval is approximately 5–8 milliseconds.

9. For a combustion-powered tool, a combined ignition and fuel system comprising a battery, two normally opened switches connected to the battery, namely a head switch and a trigger switch, a fuel injector, means for controlling the fuel injector to enable the fuel injector to inject a combustible fuel for a first time interval, means for producing ignition of the injected fuel, and means for monitoring the head and trigger switches, for disabling the injector-controlling means if the trigger switch is closed while the head switch is opened or if both switches are opened, for enabling the injector-controlling means if the trigger switch is closed while the head switch is closed, and for enabling the ignition-producing means after a second time interval succeeding the first time interval.

10. The system of claim 9 wherein the injector-controlling means is arranged to enable the ignition-controlling means when the first time interval has concluded.

11. The system of claim 10 wherein the means for monitoring the head and trigger switches is arranged for disabling the ignition-producing means when the injector-controlling means is disabled.

12. The system of claim 11 further comprising means for monitoring the battery voltage, for comparing the battery voltage monitored thereby to a reference voltage, for disabling the injector-controlling means if the battery voltage monitored thereby is less than the reference voltage, and for enabling the injector-controlling means if the battery voltage monitored thereby is not less than the reference voltage.

13. The system of claim 11 further comprising means for monitoring the battery voltage, for comparing the battery voltage monitored thereby to a reference voltage, for disabling the injector-controlling and ignition-producing means if the battery voltage monitored thereby is less than the reference voltage, and for enabling the injector-controlling and ignition-producing means if the battery voltage monitored thereby is not less than the reference voltage.

14. The system of claim 13 wherein the first time interval is about eight to about twelve milliseconds and the second time interval is about five to about eight milliseconds.

* * * * *